United States Patent [19]

Ericsson

[11] 4,354,653

[45] Oct. 19, 1982

[54] SUSPENSION DEVICE

[76] Inventor: Göte Ericsson, Stora Hestra, 330 27 Hestra, Sweden

[21] Appl. No.: 122,653

[22] Filed: Feb. 19, 1980

[51] Int. Cl.[3] ..... A47H 1/10

[52] U.S. Cl. ..... 248/317; 24/115 R; 24/115 K

[58] Field of Search ..... 248/317, 499; 24/115 R, 24/115 K, 148

[56] References Cited

U.S. PATENT DOCUMENTS

| | | | |
|---|---|---|---|
| 236,470 | 7/1925 | White . | |
| 304,491 | 1/1929 | Pxiln . | |
| 382,689 | 11/1932 | Harrison . | |
| 410,957 | 5/1934 | Swingler . | |
| 556,485 | 3/1896 | Wilson | 24/115 R |
| 1,230,757 | 5/1971 | Cawdery . | |
| 1,257,220 | 12/1971 | Chambers . | |
| 1,487,032 | 9/1977 | Dieckmann . | |
| 1,623,919 | 4/1927 | Hagen | 248/317 |
| 2,915,274 | 12/1959 | Gustitus | 248/317 |
| 3,678,543 | 7/1972 | Hobbs | 24/115 R |

FOREIGN PATENT DOCUMENTS

| | | | |
|---|---|---|---|
| 274656 | 8/1951 | Switzerland | 248/317 |

*Primary Examiner*—James Kee Chi

*Attorney, Agent, or Firm*—Howson and Howson

[57] ABSTRACT

A device for suspending an article as a signboard, a clothes hanger, or the like on a horizontally-disposed rope has a shape which cooperates with the rope to permit ready attachment but to prevent inadvertent detachment.

10 Claims, 4 Drawing Figures

SUSPENSION DEVICE

This invention relates to a suspension device for suspension on a rope of an article as a signboard, a clothes hanger, or the like, whereby the suspension device has been shaped for preventing the suspended article to fall down or to blow down.

When suspension of articles, one has usually effected the suspension by using loop-shaped suspension hooks, especially when suspension of such articles, which easily and comfortably could be suspended or be taken down from a rope. That is the case for conventional clothes hanger, which often are used for suspension of laundry out to dry. Hereby, it often occurs that the clothes hanger leave hold of the suspension rope due to the influence of wind, whereby the laundry falls down. That problem is the same in several similar connections, for example when suspension of posters, advertising bills, information posts, signboards or for example when suspension of plates on temporary blocking ropes or the like.

Therefore, the aim of this invention is to produce a suspension device, which permits a fast and comfortable suspension of an article on a rope, line or the like and without any risk for the suspended article to blow down.

That aim will be attained in accordance with the invention, if the suspension device—which includes a middle portion, which is oriented essentially perpendicular to the rope, said middle portion has two legs at its top end, each leg shaped as a hook, said legs are intended to be carried by the ope—is characterized by the fact that the legs have portions, which together with said middle portion form upwards and in the longitudinal direction of the rope closed spaces through which the rope is intended to run, each of said legs has a free end equipped with a head. Further, if said heads have a cross-section bigger than the cross-section of said legs at their portions adjacent to the rope.

According to an additional embodiment of the device in accordance with the invention are said meddle portion and said legs arranged mainly in the same level. By this, one attains on one hand a favourable manufacturing and on the other hand an improvement of the safety against a blow down of the device.

Figure 1:
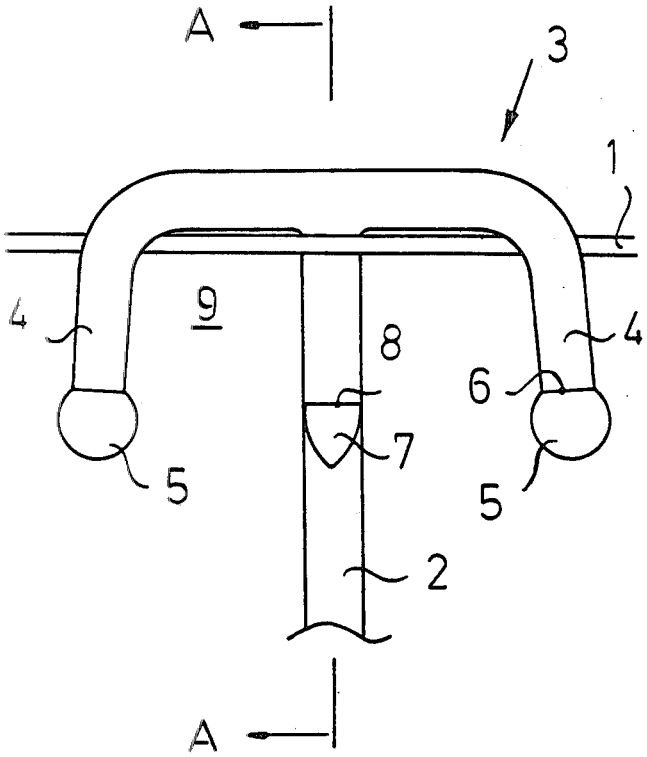
Figure 2:
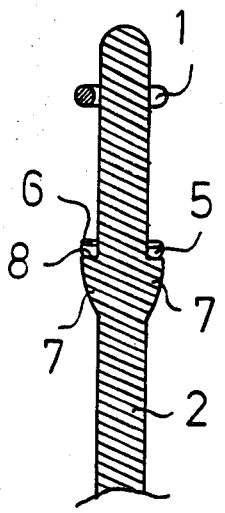
Figure 3:
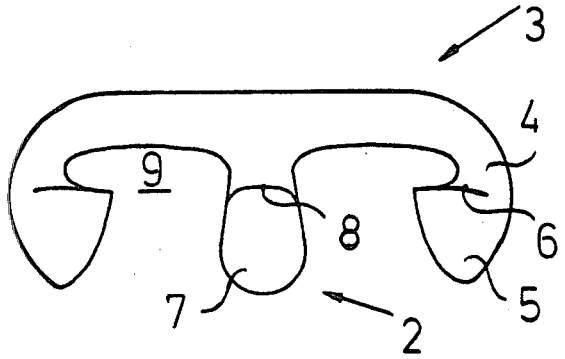
Figure 4:
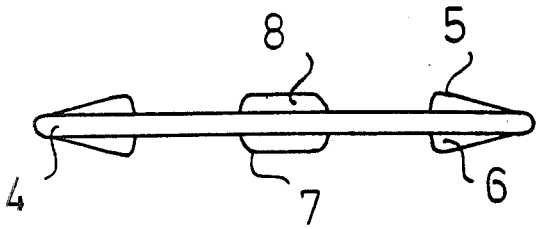

Embodiments of the invention will be described in more detail in the following with reference to the accompanying drawings, in which FIG. 1 shows schematically one suspension device according to the invention and which device is suspended on a rope, FIG. 2 shows a section along the line A—A of FIG. 1, FIG. 3 shows an alternative design of a suspension device, which is shaped as a clothes peg, and FIG. 4 shows from above the embodiment of FIG. 3.

As it is evident from FIG. 1, the suspension device according to the invention is intended for suspension on a rope 1. The suspension device includes a middle portion 2, whereby the bottom of said middle portion is intended to be fixed to the article, which is to be suspended. Said article can for example be represented by a clothes hanger, a signboard, a tarpaulin or a cover or something like that. As it is evident from the drawings, the top of the middle portion 2 is united to two legs 3, running in opposite directions. Each of said legs is shaped as a hook, whereby each leg has one downwards directed portion 4, which possibly can run parallel with said middle portion 2. Said downwards directed portions 4 and said legs 3 are provided with heads 5, having bigger cross-sections compared with the legs 3, at least concerning the parts of the legs adjacent to the rope 1. According to a suitable embodiment of said heads 5, they are furnished with blocking surfaces 6, which are arranged essentially perpendicular to the plane of the drawing and essentially perpendicular to the longitudinal direction to said downwards directed portions 4 of the legs 3. Further, the middle portion 2 is also furnished with two protuberances 7, which are directed in opposite directions and each furnished with a blocking surface 8, which is arranged essentially perpendicular to the plane of the drawing and perpendicular to the longitudinal direction of said middle portion 2.

If the suspension device is shaped for suspension of a clothes hanger, the legs 3 are suitable shaped more continuously and gently bended than is shown on the drawings. The distance between the heads 5 and the middle portion 2 is suitably so large that the suspension device also can be comfortably suspended on a common suspension rod.

The suspension device according to the invention is used in the following manner. When suspension of an article, one can for example first bring the middle portion 2 to lie close to the rope 1 and therewith at a point below the heads 5. After that the middle portion is conveyed laterally so that the rope is bent to a V-shape, seen from above. Then the suspension device is lowered in such a way that the rope passes behind the both heads simultaneously as the rope slides over the protuberances 7 of the middle portion and into the spaces 9, which are limited upwards and laterally on one hand by the middle portion and on the other hand by the legs. As soon as the rope 1 has passed the heads 5 and the protuberances 7, the laterally directed force against the rope by means of the middle portion is discontinued. Hereby, the rope will slide along the top of the middle portion and the top of said downwards directed portions 4 of the legs, whereby the rope takes the position as shown in FIG. 1. In that position, the rope runs behind the both legs 3 but in front of the middle portion 2. Hereby, the weight of the middle portion 2 will cause a stretching force in the rope. Said force will be greater the greater the weight is. This causes a proportional contacting force between the rope and one of the side surfaces of the legs 3 and the opposite side surface of the middle portion 2.

In practical and where the suspension device is for example placed to a clothes hanger, which is suspended on a rope for laundry out to dry, the influence of the wind can not cause the suspension device to release from the rope. Certainly, the clothes hanger can turn round the longitudinal direction of the rope, but on the other hand the clothes hanger can not turn round the longitudinal direction dictated by the middle portion 2. Further, one also prevent a turning round an axis, which is perpendicular to both the longitudinal direction of the middle portion 2 and the longitudinal direction of the rope 1, as the blocking surfaces 6 and 8 will engage the rope 1, whereby the rope is prevented passing said blocking surfaces 6 and 8 because of the increased contacting forces sideways on one hand between the rope and the middle portion and on the other the rope and the legs, which increased forces are causes by the wind.

In FIGS. 3 and 4 is shown an alternatively embodiment of the device in accordance with the invention, which device on one hand can be used as a suspension device as described above and on the other hand can be advantageously used instead of conventional clothes pegs. As it is evident from the drawing, this embodiment shows also legs 3, which are located in the same level and which are united to a middle portion 2. Further, the legs 3 show downwards directed portions 4, which at the bottom end are furnished with heads 5. The limit passing area between the heads 5 and the legs 4 is shaped as blocking surfaces 6, which can be more or less shaped as a step or drop compared with the legs 3, which are shaped as a sheet, as it is evident from FIG. 4. This embodiments shows also that the top part of the middle portion 2 can be shaped with essentially the same thickness as the legs 3.

The spaces 9, which are contemplated to receive the rope 1, are shaped in some different way than the case according to the embodiments in accordance with FIGS. 1 and 2. Thus, the spaces 9 are partly closed downwards, i.e. in the direction towards the heads 5 and therewith by the fact that said heads extend in the direction towards the middle portion 2 of the suspension device. Owing to this shape of the spaces 9 and the heads 5 is obtained a further improvement of the holding force when the device is suspended on a rope. The rope is intended to run for example behind the both legs 3 through the spaces 9 and in front of the top of the middle portion 2.

The suspension device according to FIGS. 3 and 4 is also functioning with advantage as a replacement device for a conventional clothes peg. Hereby, the laundry or the clothes are suspended on a rope and turned round the rope before the suspension device is applied to the rope and the laundry or the clothes, whereby the rope is enclosed by the laundry or the clothes.

It is not necessary to shape the blocking surfaces 6 and 8 as described above. Instead and with particular reference to the embodiments according to FIGS. 3 and 4, it can be advantageously to shape the top of the suspension device with a more gentle configuration and shape said top portion so the portion more continuously passes into the heads 5 and protuberances 7. Such a shape can be advantageous to make the detatching easier of the suspension device, especially when the rope is stretched tight.

The suspension device according to this invention as the clothes-peg are of a one-piece moulded plastic construction having a central portion (2) and a pair of substantially co-planar leg (3) portions, which project from the central portion in opposite directions, whereby the device or clothes-peg can in use be engaged with a clothes-line in such manner that one side of said line engages the two legs portions and the opposite side of the line engages the central portion.

Without exceeding the scope of the concept of the invention, modifications may be made to the suspension device shown and described. Thus, it is possible to vary the shape of the legs 3 as long as there are spaces between the legs and the middle portion and which spaces have openings downwards and are closed upwards and in the longitudinal direction of the rope 1. Further, the head of the middle portion 2 can of course be placed almost anywhere along said closed spaces 9 if there only exists a sufficient space for the rope above the protuberances 7. There can also be arranged on the middle portion and also on said downwards directed portions 4 of the legs 3 several protuberances arranged in a row. It is also possible to shape the suspension device asymmetrically by for example replace said heads 5 with short, bended portions, which longitudinal directions are essentially perpendicular to the level of the drawings (FIG. 1). Therefore, the invention is not limited to the embodiments shown, but only by the following patent claims.

I claim:

1. A device for attaching an article to a line, such as a clothes line, comprising a main leg adapted at one end to engage one side of said line and having a depending portion with a protuberance spaced from said one end, a pair of auxiliary legs extending in opposite directions from said one end of the main leg with each auxiliary leg having a downturned end portion with a protuberance, the protuberance on the main leg having at least one laterally-extending portion and the protuberances on the auxiliary legs each having laterally-extending portions directed toward the protuberance on the main leg so that when the device is mounted on a line with the main leg engaging one side of the line and the auxiliary legs engaging the opposite side of the line, the protuberances cooperate to resist accidental detachment of the device from the line.

2. A device according to claim 1 wherein said protuberances on said auxiliary legs are located at substantially the same distance as the protuberance on said main leg to engage the line.

3. A device according to claim 1 wherein each of said protuberance portions is provided by a planar surface forming an abrupt step from which it extends to enhance the resistance of the device to accidental detachment from a line.

4. A device according to claim 1 wherein said protuberances have portions provided on both sides of the main leg.

5. A device according to claim 1 wherein said protuberances have portions provided on both sides of said auxiliary legs.

6. A device according to claim 1 wherein the protuberances on the auxiliary legs are provided by enlarged heads located at the extremity of each of said legs.

7. A device according to claim 1 wherein the two auxiliary legs form a substantially U-shaped configuration with the main leg extending from the base of the U and lying parallel to two arms of the U to define an E-shaped structure.

8. A device according to claim 1 including means depending from said main leg for supporting an article below the protuberance thereon.

9. A device according to claim 1 wherein the main leg and the auxiliary legs are of substantially the same length so that the device can be used to clamp clothes to a line.

10. A device according to claim 1 wherein the main and auxiliary legs are of one-piece molded plastic construction.

* * * * *